US008376482B2

(12) United States Patent
An et al.

(10) Patent No.: US 8,376,482 B2
(45) Date of Patent: Feb. 19, 2013

(54) REFRIGERATOR

(75) Inventors: Jae Koog An, Gwangju (KR); Jin Ho Kim, Gwangju (KR); Ji Hoon Kim, Gwangju (KR); Sang Min Park, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 621 days.

(21) Appl. No.: 12/401,666

(22) Filed: Mar. 11, 2009

(65) Prior Publication Data

US 2009/0308098 A1 Dec. 17, 2009

(51) Int. Cl.
*A47B 96/02* (2006.01)

(52) U.S. Cl. ..... 312/408

(58) Field of Classification Search ..... 312/401, 312/408, 410, 351, 116, 228.1; 108/106, 108/108; 62/382, 440, 441; 126/337 R, 126/337 A, 339
See application file for complete search history.

(56) References Cited

U.S. PATENT DOCUMENTS

| | | | | |
|---|---|---|---|---|
| 575,185 | A * | 1/1897 | Weber | 126/340 |
| 1,986,035 | A * | 1/1935 | Wells | 254/122 |
| 2,284,339 | A * | 5/1942 | Nauert | 312/323 |
| 2,641,247 | A * | 6/1953 | Genebach | 126/337 A |
| 4,220,133 | A * | 9/1980 | Way, Jr. | 126/337 A |
| 4,528,825 | A * | 7/1985 | Khan | 62/441 |
| 5,913,584 | A | 6/1999 | Swindell | 312/408 |
| 7,950,756 | B2 * | 5/2011 | Collins et al. | 312/408 |
| 2004/0195945 | A1 * | 10/2004 | Farber et al. | 312/408 |
| 2004/0207305 | A1 * | 10/2004 | Kim et al. | 312/408 |
| 2006/0043848 | A1 * | 3/2006 | Jeong et al. | 312/310 |
| 2006/0097613 | A1 * | 5/2006 | Lee et al. | 312/408 |
| 2007/0096610 | A1 * | 5/2007 | Filho et al. | 312/408 |

FOREIGN PATENT DOCUMENTS

| | | |
|---|---|---|
| KR | 10-2006-0030563 | 4/2006 |
| WO | WO 2006/122913 | * 11/2006 |

* cited by examiner

*Primary Examiner* — James O Hansen

(74) *Attorney, Agent, or Firm* — Staas & Halsey LLP

(57) ABSTRACT

A refrigerator is disclosed. The refrigerator includes a storage compartment, and a shelf assembly provided in the storage compartment to be vertically adjustable, wherein the shelf assembly includes a support unit provided to be movable obliquely, and a shelf unit which is mounted on the support unit to move up and down according to an oblique movement of the support unit. The refrigerator has a simple structure capable of lifting a shelf up and down, thereby facilitating the manufacture and reducing manufacturing costs.

24 Claims, 12 Drawing Sheets

REFRIGERATOR

CROSS-REFERENCE TO RELATED APPLICATION

This application claims the benefit of Korean Patent Application No. 2008-0055157, filed on Jun. 12, 2008 in the Korean Intellectual Property Office, the disclosure of which is incorporated herein by reference.

BACKGROUND OF THE INVENTION

1. Field of the Invention

The present invention relates to a refrigerator, and, more particularly, to a vertically adjustable refrigerator.

2. Description of the Related Art

Generally, a plurality of shelves are installed in a storage compartment of a refrigerator. The shelves, spaced from each other in a vertical direction, divide an inside of the storage compartment in multiple steps to increase space utilization efficiency and allow articles to be easily stored therein.

Among conventional shelves for refrigerators, there is a shelf vertically adjustable by a user. An adjustable shelf disclosed in U.S. Pat. No. 5,913,584 includes a mounting assembly fixed to the rear surface of a storage compartment of a refrigerator, a shelf support assembly coupled to the mounting assembly to be vertically movable, a shelf coupled to the shelf support assembly, and a driving unit which lifts the shelf support assembly up and down.

The above-mentioned driving unit includes a worm driving gear which is rotated by an operation of the user, a driven gear which is rotated by the driving gear, a gear shaft which is rotated by the driven gear, two spur gears coupled to the opposite ends of the gear shaft, and a gear box which rotatably supports the driving gear and the gear shaft. The gear box is fixed to the shelf support assembly. The driving unit further includes a gear bracket fixed to the mounting assembly and two rack gears installed at the opposite sides of the gear bracket to engage with two spur gears coupled to the opposite ends of the gear shaft. In the driving unit, when the user rotates a rotation knob connected to the driving gear through an operational rod, the two spur gears coupled to the gear shaft are rotated. As a result, the shelf support assembly is lifted up and down.

In the conventional adjustable shelf, however, there are problems of reducing productivity and increasing the manufacturing costs because the elevation unit, which lifts the shelf support member up and down, has a complicated configuration.

Further, the conventional adjustable shelf is applicable only to a track type shelf fixing structure formed on the rear surface of the refrigerator. Accordingly, it is difficult to apply the conventional adjustable shelf to a refrigerator having no track.

The conventional adjustable shelf is mounted to the track provided at the rear surface of the refrigerator. That is, the conventional adjustable shelf is cantilevered at one end thereof. For this reason, the shelf should be manufactured of a material having sufficient stiffness, for example, steel, in order to support load applied to the shelf.

Further, since the rear surface of the conventional adjustable shelf is mounted to the track provided at the rear surface of the refrigerator, a shelf frame should be manufactured of a material having sufficient stiffness, for example, steel, in order to support load applied to the shelf.

SUMMARY OF THE INVENTION

The present invention has been made in order to solve the above problems. It is an aspect of the invention to provide a refrigerator having a simple structure capable of lifting a shelf up and down, thereby facilitating the manufacture and reducing manufacturing costs.

Further, it is another aspect of the invention to provide a refrigerator having a shelf driving unit applicable to a refrigerator having no track.

Further, it is a further aspect of the invention to provide a refrigerator having a support performance required for a shelf even though the shelf is manufactured using an inexpensive material having insufficient stiffness.

Additional aspects and/or advantages of the invention will be set forth in part in the description which follows and, in part, will be obvious from the description, or may be learned by practice of the invention.

In accordance with an aspect of the invention, there is provided a refrigerator comprising: a storage compartment; and a shelf assembly provided in the storage compartment to be vertically adjustable, wherein the shelf assembly includes a support unit provided to be movable obliquely, and a shelf unit which is mounted on the support unit to move up and down according to an oblique movement of the support unit.

Preferably, the shelf assembly further includes a driving unit to drive the support unit.

Preferably, the driving unit is a pressing/fixing unit including a plurality of engaging portions provided in the shelf unit, and a stopper provided in the support unit such that the stopper is selectively coupled to and separated from any one of the engaging portions.

Preferably, the pressing/fixing unit further includes a pressing portion which moves the stopper forward and backward, and the stopper interlocking with the pressing portion is separated from the engaging portions when a certain external force is applied to the pressing portion.

Preferably, the driving unit is a rotation driving unit including a threaded portion, and the rotation driving unit allows the support unit to move forward and backward along inclined portions of guide units by a rotation of the threaded portion.

Preferably, the rotation driving unit further includes a knob which is grasped by a user to rotate the threaded portion.

Preferably, the refrigerator further includes guide units having inclined portions which guide the oblique movement of the support unit.

Preferably, the guide units include a pair of guide units fixed to opposite side surfaces of the storage compartment.

Preferably, the shelf unit further includes extended portions, and the guide units further include guide portions which receive the extended portions to guide an elevation of the shelf unit.

Preferably, the guide units having the inclined portions which guide the oblique movement of the support unit are formed integrally with opposite sidewalls of the storage compartment.

Preferably, the inclined portions are arranged parallel to each other.

Preferably, the support unit includes a frame which supports the shelf unit and legs which are extended from the frame and supported by the inclined portions.

Preferably, the legs move obliquely along the inclined portions.

Preferably, the legs further include rollers to be smoothly movable along the inclined portions.

Preferably, the shelf unit is vertically lifted up according to an upward oblique movement of the support unit, and is vertically lifted down according to a downward oblique movement of the support unit.

Preferably, the support unit moves forward and backward with respect to the shelf unit.

In accordance with another aspect of the invention, there is provided a refrigerator comprising: a storage compartment; and a shelf assembly provided in the storage compartment, wherein the shelf assembly includes guide units provided at opposite sidewalls of the storage compartment and having inclined portions, a support unit moving along the inclined portions, and a shelf unit which is coupled to the support unit to move up and down according to a movement of the support unit.

Preferably, the shelf assembly further includes a pressing/fixing unit having a plurality of engaging portions provided in the shelf unit, a stopper provided in the support unit and selectively coupled to and separated from any one of the engaging portions, and a pressing portion which moves the stopper forward and backward.

Preferably, the shelf assembly further includes a rotation driving unit which allows the support unit to move forward and backward along the inclined portions of the guide units by a rotation of a threaded portion.

In accordance with a further aspect of the invention, there is provided a refrigerator comprising: a storage compartment; and a shelf assembly provided in the storage compartment to be vertically adjustable, wherein the shelf assembly includes a shelf unit, a support unit provided to move forward and backward with respect to the shelf unit and move up and down, a driving unit which drives the support unit, and guide units which guide an oblique movement of the support unit.

The refrigerator according to the present invention has a simple structure capable of lifting a shelf up and down, thereby facilitating the manufacture and reducing manufacturing costs.

Further, the refrigerator according to the present invention provides a shelf driving unit applicable to a refrigerator having no track.

Further, the refrigerator according to the present invention offers a support performance required for a shelf even though the shelf is manufactured using an inexpensive material having insufficient stiffness.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
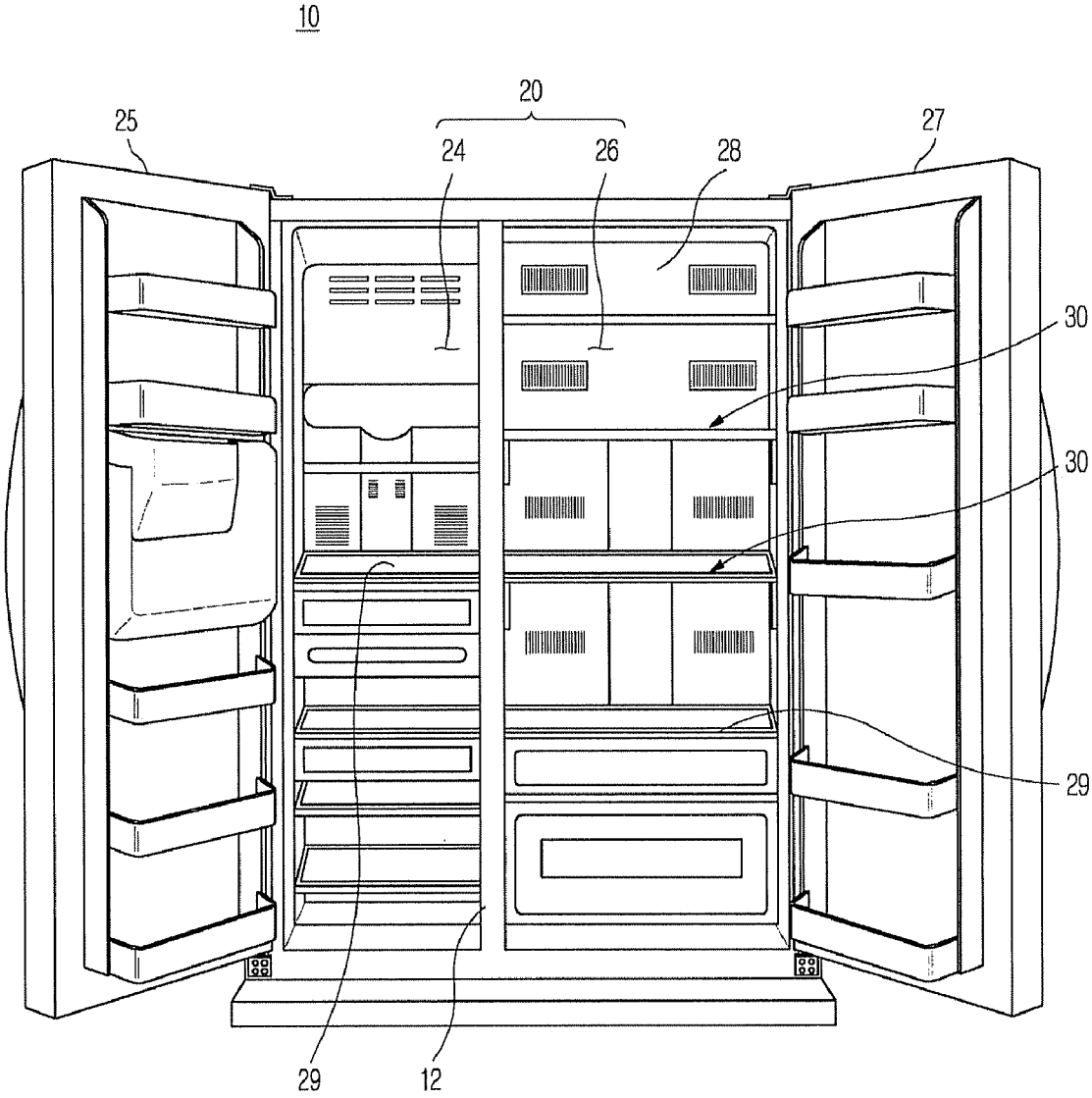
FIG. 1 illustrates a perspective view of a refrigerator having a shelf assembly according to a first embodiment of the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

Hereinafter, the present invention will be described in detail with reference to the accompanying drawings.

Figure 2:
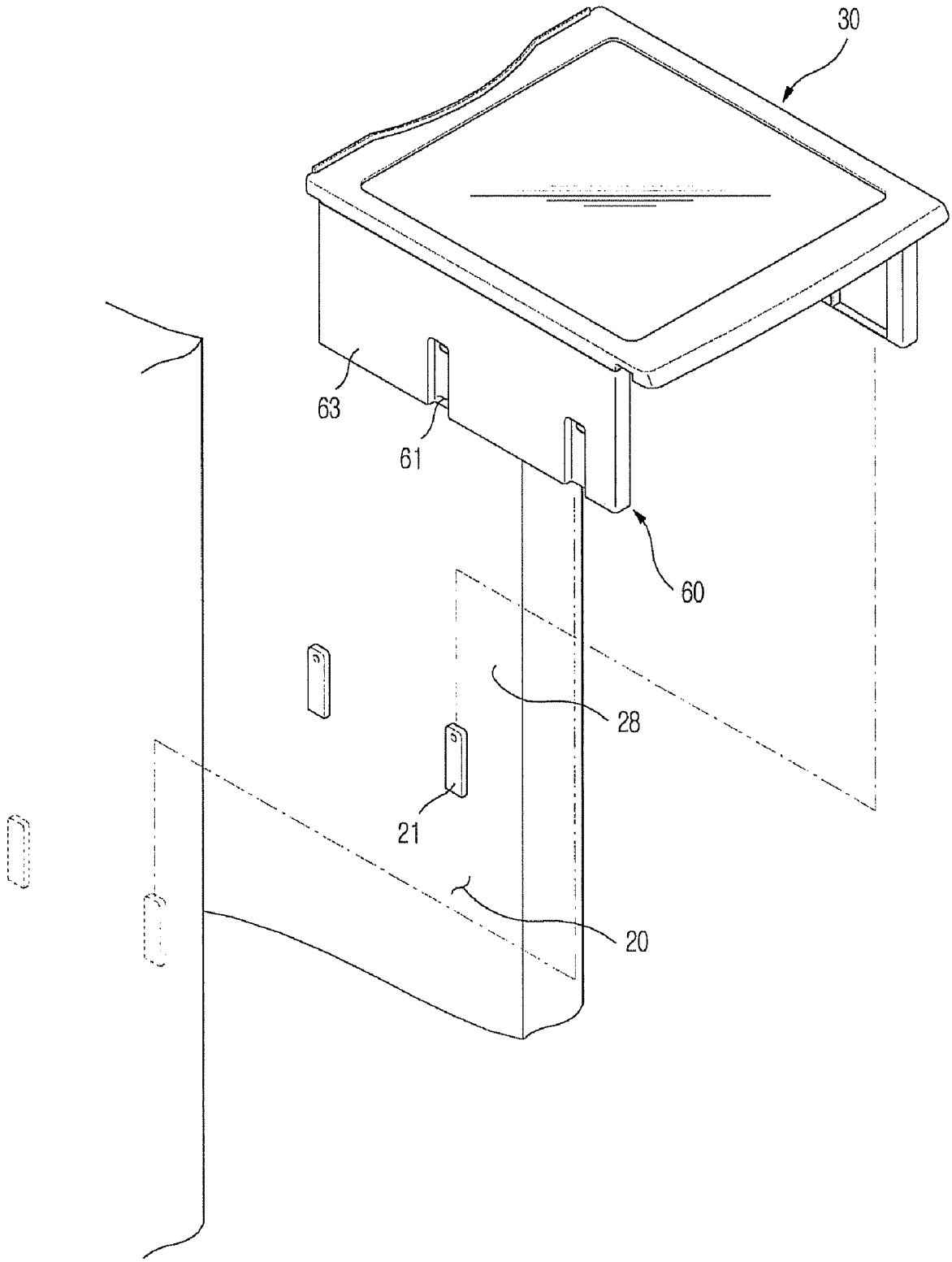
FIG. 2 illustrates a perspective view of the shelf assembly of FIG. 1.

FIG. 1 illustrates a perspective view of a refrigerator having a shelf assembly according to a first embodiment of the present invention. FIG. 2 illustrates a perspective view of the shelf assembly of FIG. 1.

As shown in FIGS. 1 and 2, a refrigerator 10 according to the first embodiment of the present invention includes a storage compartment 20 and a shelf assembly 30 disposed in the storage compartment to be vertically adjustable.

The storage compartment 20 is divided into a freezing compartment 24 and a cooling compartment 26 by a vertical partition wall 12. The freezing compartment 24 and the cooling compartment 26 are opened and closed by a freezing compartment door 25 and a cooling compartment door 27, respectively. The storage compartment 20 is provided with a number of shelves. The shelves partition the inner space of the storage compartment 20 in a vertical direction such that the inner space can be efficiently used. The shelves may include a fixed shelf 29 fixed to an inner wall 28 of the storage compartment 20 and the shelf assembly 30 which is vertically adjustable.

The shelf assembly 30 is vertically adjustable according to the size of an article stored in the storage compartment 20. That is, if an article to be stored under the shelf assembly 30 has a large volume, the shelf assembly 30 can be moved upward. On the other hand, if an article to be stored under the shelf assembly 30 has a small volume, the shelf assembly 30 can be moved downward such that the space above the shelf assembly 30 can be efficiently used. In a case of the fixed shelf 29, if a stored article is large, the fixed shelf 29 is completely extracted forward and removed such that the inner space of the storage compartment 20 can be efficiently used. On the other hand, in a case of the shelf assembly 30, the shelf assembly 30 can be variously adjusted in vertical position only with a simple operation without being separated from the supercooling compartment 20. The shelf assembly 30 is engagedly coupled to protruding parts 21 provided at opposite sides of the inner wall 28 of the storage compartment 20. The protruding parts 21 are coupled to engaging parts 61 provided at outer side surfaces 63 of guide units 60 of the shelf assembly 30. The shelf assembly 30 is firmly fixed to the inner wall 28 of the storage compartment 20 as the engaging parts 61 are slidably coupled to the protruding parts 21 provided at four positions, respectively. Hereinafter, the shelf assembly 30 according to the first embodiment of the present invention will be described in detail with reference to FIGS. 3 and 4.

Figure 3:
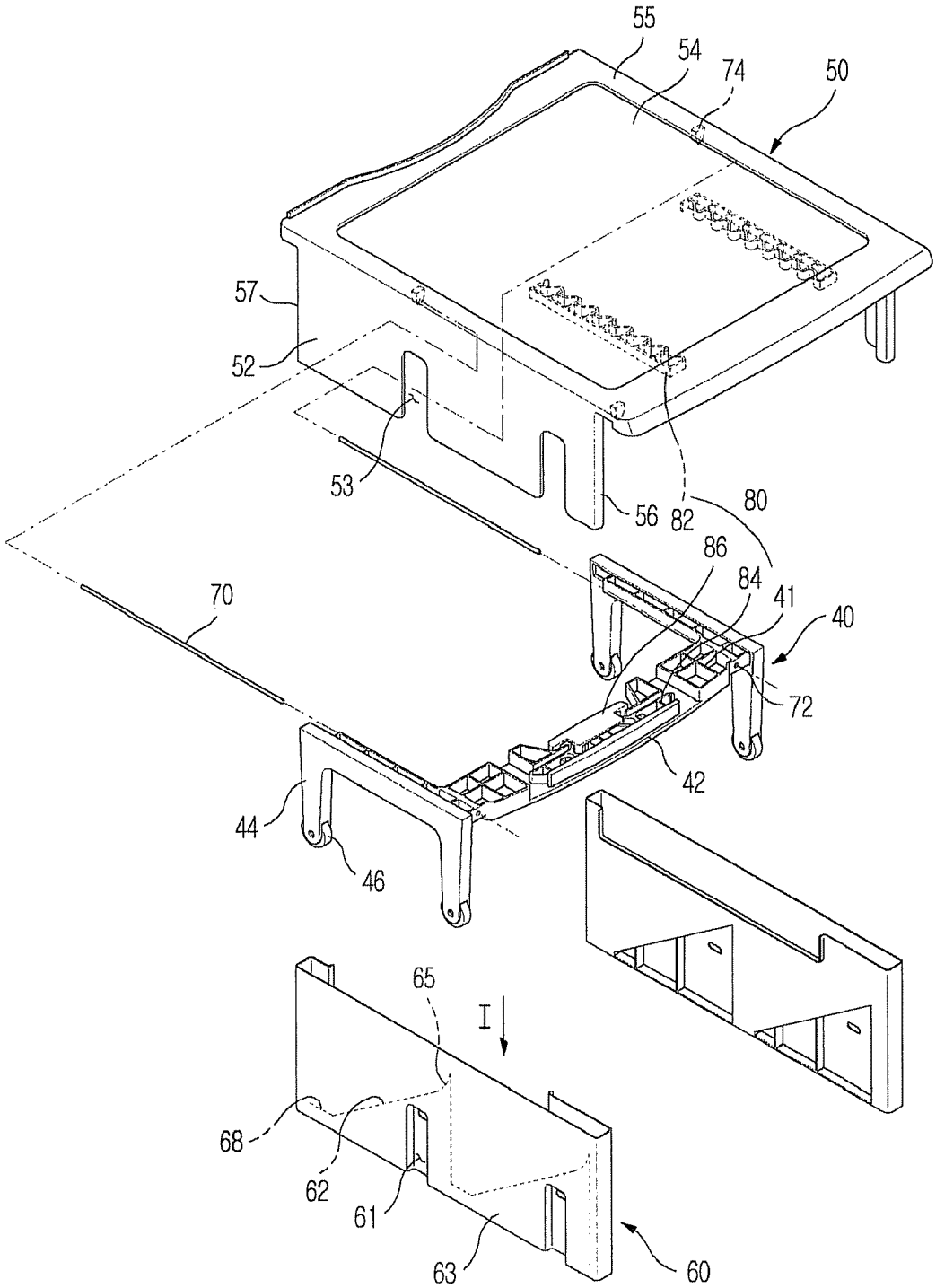
FIG. 3 illustrates an exploded perspective view of the shelf assembly of FIG. 2.
Figure 4:
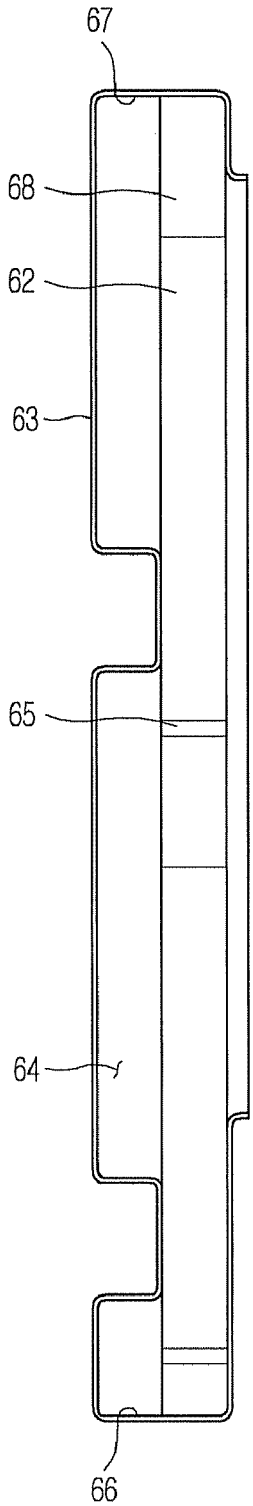
FIG. 4 illustrates a plan view of the guide unit of FIG. 3 seen in an I direction.

FIG. 3 illustrates an exploded perspective view of the shelf assembly of FIG. 2, and FIG. 4 illustrates a plan view of the guide unit of FIG. 3 seen in an I direction.

As shown in the drawings, the shelf assembly 30 according to the first embodiment of the present invention includes a support unit 40 disposed to be movable obliquely, a shelf unit 50 which is mounted on the support unit 40 to move up and down according to an oblique movement of the support unit 40, the guide units 60 which guide the oblique movement of the support unit 40, guide bars 70 which guide a forward and backward movement of the support unit 40, and a pressing/fixing unit 80 which fixes the support unit 40 at a desired position in the oblique movement of the support unit 40.

The support unit 40 moves up and down while moving in forward and backward directions along inclined portions 62 provided at the guide units 60. Accordingly, the support unit 40 moves in oblique directions. That is, when the support unit 40 moves forward, the support unit 40 moves upward along the inclined portions 62 simultaneously with the forward movement. When the support unit 40 moves backward, the support unit 40 moves downward along the inclined portions 62 simultaneously with the backward movement. When the support unit 40 moves up and down, the shelf unit 50 also moves up and down because the shelf unit 50 is placed on the support unit 40. However, even when the support unit 40 moves forward and backward, the shelf unit 50 does not move forward and backward. This is so because the forward and backward movement of extended portions 52 of the shelf unit 50 is restricted by front and rear wall surfaces 66 and 67 of guide portions 64 disposed on the guide units 60. The detailed description thereof will be given later. The support unit 40 includes a frame 42 which supports the shelf unit 50, legs 44 extended from the frame 42, and rollers 46 disposed at ends of the legs 44.

The frame 42 is a skeleton forming an upper portion of the support unit 40. The frame 42 includes reinforcement ribs 41 to support the weight of the shelf unit 50 mounted on the frame 42 and stored articles to be placed on the shelf unit 50.

The legs 44 are extended downward at four positions of the frame 42, respectively. The legs 44 distribute load applied to the frame 42 and transfer the load to the rollers 46 disposed at lower portions of the legs 44.

The rollers 46 are in direct contact with the inclined portions 62. When the user moves the support unit 40 forward or backward, the support unit 40 smoothly moves forward and backward along the inclined portions 62 because the rollers 46 are provided at the ends of the legs 44 to perform a rolling motion.

The shelf unit 50 is coupled to an upper portion of the support unit 40 to allow the stored articles to be placed thereon. The shelf unit 50 has a flat upper surface such that the stored articles can be easily placed thereon. The shelf unit 50 includes a transparent or semitransparent shelf member 54 and a frame 55 that may be formed integrally with or separately from the shelf member 54 to be coupled with the shelf member 54. The frame 55 may be formed by injection molding a resin material. As described above, the extended portions 52 are also included in the shelf unit 50.

The extended portions 52 are formed to be bent downward from the shelf unit 50. The extended portions 52 are inserted into the guide portions 64 disposed inside the guide units 60. Evading parts 53 are formed at positions of the extended portions 52 corresponding to the engaging parts 61 of the guide units 60. Since the evading parts 53 are provided, the extended portions 52 can be inserted into the guide portions 64 even though the engaging parts 61 are formed. Front and rear surfaces 56 and 57 of the extended portions 52 may be in contact with the front and rear wall surfaces 66 and 67 inside the guide units 60 to restrict the forward and backward movement of the shelf unit 50. Accordingly in this embodiment, even when the support unit 40 moves forward and backward while moving vertically, the shelf unit 50 moves only vertically.

The guide units 60 are coupled to the protruding parts 21 (see FIG. 2) to guide the oblique movement of the support unit 40. The guide units 60 are provided as a pair of guide units such that two legs 44 are inserted into one of the guide units 60. The rollers 46 provided at the ends of the legs 44 perform a rolling motion while being in contact with the inclined portions 62 provided inside the guide units 60. Thus, the guide units 60 include the inclined portions 62 and the guide portions 64 into which the extended portions 52 of the shelf unit 50 are inserted.

The two inclined portions 62 are provided in one of the guide units 60. Flat portions 68 are formed on the bottom surfaces at the ends of the inclined portions 62, and stop ribs 65 are formed at the upper ends of the inclined portions 62 to prevent separation of the rollers 46. When the rollers 46 are positioned at the flat portions 68, the shelf unit 50 is at the lowest state in a downward direction. On the other hand, when the support unit 40 is extracted forward, the rollers 46 can move upward in an oblique direction along the inclined portions 62. The rollers 46 move to the stop ribs 65 along the inclined portion 62. At the moment when the rollers 46 reach the stop ribs 65, the shelf unit 50 is at the highest state in an upward direction. When the shelf unit 50 is at the highest state in an upward direction, an article having a large volume can be stored in a space under the shelf unit 50. Since the inclined portions 62 generally have an inclined shape enabling movement of the rollers 46, the inclined shape of the inclined portions 62 may also have a discontinuous shape or a non-uniform gradient.

The guide portions 64 are spaces formed in the guide units 60. Each of the guide portions 64 is divided into three portions by the two engaging parts 61. As described above, since the evading parts 53 are formed on the extended portions 52 inserted into the guide portions 64, the extended portions 52 can be inserted into the guide portions 64 without interfering with the engaging parts 61. The guide portions 64 include a plurality of the front and rear wall surfaces 66 and 67 due to the shape of the engaging parts 61 protruded toward the inside of the guide portions 64. The front and rear wall surfaces 66 and 67 are in contact with the front and rear surfaces 56 and 57 of the extended portions 52 to restrict the forward and backward movement of the shelf unit 50. Accordingly, even when the support unit 40 moves forward and backward while moving vertically, the shelf unit 50 moves only vertically.

The guide bars 70 allow the support unit 40 to smoothly move forward and backward. The guide bars 70 connect the shelf unit 50 with the support unit 40. That is, the guide bars 70 pass through guide holes 72 formed on the support unit 40 and, then, the opposite ends of the guide bars 70 are fixed to projection parts 74 formed on the shelf unit 50. Since the diameter of the guide holes 72 is larger than the diameter of the guide bars 70, the forward and backward movement of the support unit 40 is not restricted by the guide bars 70.

The pressing/fixing unit 80 is a driving unit which enables the shelf unit 50 to be fixed at a certain vertical position after being moved. Once the user decides an appropriate vertical position of the shelf unit 50 while moving the support unit 40 forward and backward to adjust the vertical position of the shelf unit 50, it is possible to simply fix the shelf unit 50 at the decided position using the pressing/fixing unit 80. On the contrary, it is also possible to easily re-move the fixed shelf unit 50 to a desired position. The pressing/fixing unit 80 is arranged between the opposite surfaces of the support unit 40 and the shelf unit 50. Hereinafter, the configuration of the pressing/fixing unit 80 will be described in detail with reference to FIGS. 5 and 6.

Figure 5:
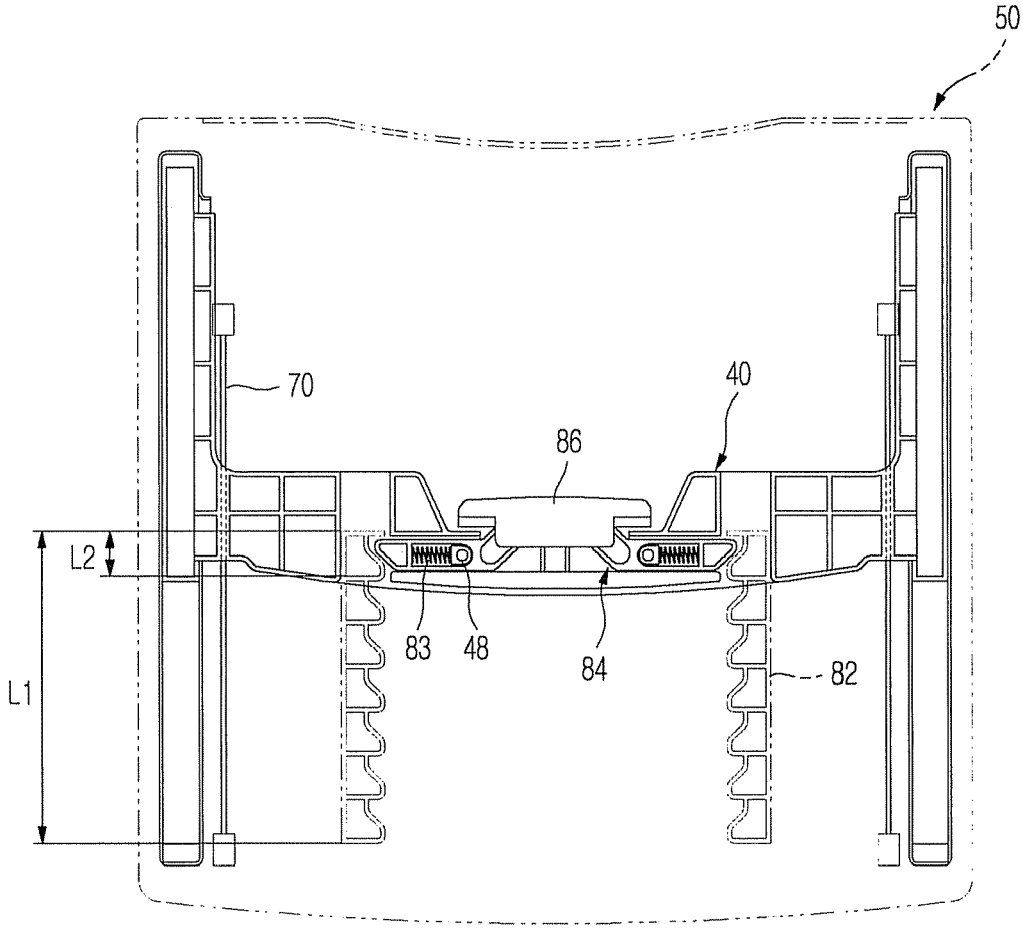
FIGS. 5 and 6 illustrate plan views showing a configuration and an operation of the pressing/fixing unit of FIG. 3.
Figure 6:
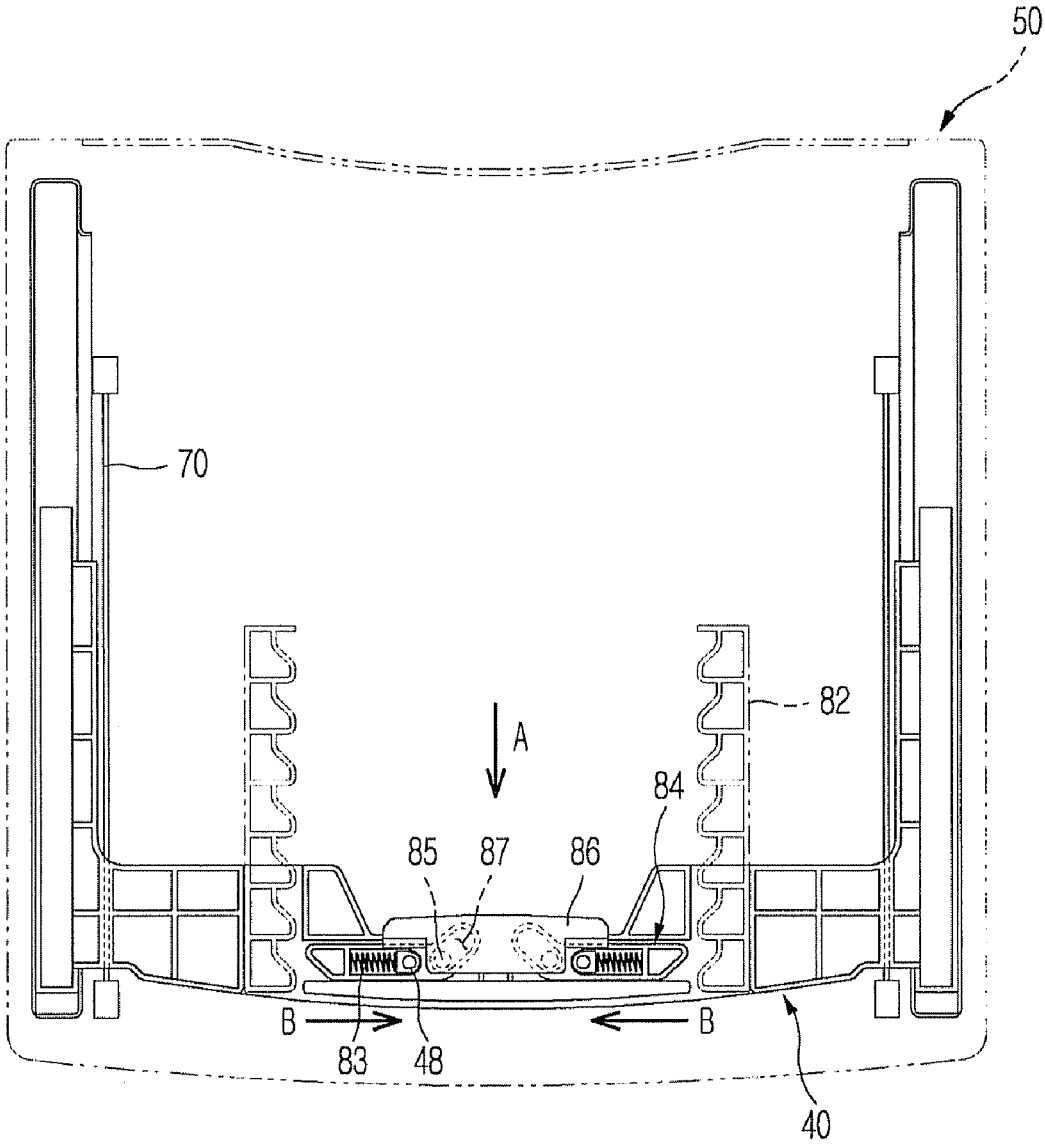

FIGS. 5 and 6 illustrate plan views showing a configuration and an operation of the pressing/fixing unit of FIG. 3.

As shown in FIGS. 5 and 6, the pressing/fixing unit 80 includes a plurality of engaging portions 82, a stopper 84 coupled to any one of the engaging portions 82, and a pressing portion 86 which moves the stopper 84 forward and backward.

The engaging portions 82 include ribs formed repeatedly at opposite sides on the lower surface of the shelf unit 50 such that the opposite ribs face each other. A total length L1 of the engaging portions 82 in the forward and backward directions corresponds to a height L4 (see FIG. 8) by which the support unit 40 (see FIG. 3) is lifted up while moving in the oblique direction along the inclined portions 62 (see FIG. 3). A length L2 of each of the engaging portions 82 corresponds to a height by which the shelf unit 50 (see FIG. 3) can be lifted up or down at one time. That is, when the length L2 of the engaging portions 82 is small, it is possible to lift the shelf unit 50 up and down while finely adjusting the position of the shelf unit 50 (see FIG. 3).

The stopper 84 is coupled to or uncoupled from the engaging portions 82. The ends of the stopper 84 are formed corresponding to the engaging portions 82. That is, the size of the ends of the stopper 84 corresponds to the length L2 of the engaging portions 82. The stopper 84 and the engaging portions 82 are in close contact with each other by an elastic force of elastic springs 83 provided in the stopper 84 until the user applies an external force thereto. One side of the elastic springs 83 are supported by ribs 48 protruded from the support unit 40, and the other side of the elastic springs 83 are supported by the stopper 84. Accordingly, when an external force is not exerted, the stopper 84 is maintained in a state of being engaged with the engaging portions 82 by the elastic force of elastic springs 83.

The pressing portion 86 is a portion which is substantially operated by the user to adjust the vertical position of the shelf unit 50. When the user performs a grasping action after he supports a front end portion of the support unit 40 with the thumb and grabs the pressing portion 86 with the other fingers, the pressing portion 86 is moved in a pressing direction A. When the pressing portion 86 moves in the pressing direction A, the stopper 84 is moved in a separation direction B and separated from the engaging portions 82. That is, when the pressing portion 86 is moved in the pressing direction A by an external force applied to the pressing portion 86, projections 85 formed integrally with the pressing portion 86 are also moved in the pressing direction A. The projections 85 are inserted into coupling holes 87 formed in the stopper 84 in the oblique directions. Accordingly, while the pressing portion 86 moves in the pressing direction A, the projections 85 press the inner surfaces of the coupling holes 87 to move the stopper 84 in the separation direction B.

The operation of the refrigerator and the shelf assembly having the above configuration according to the first embodiment of the present invention will be described with reference to FIGS. 5 to 8.

Figure 7:
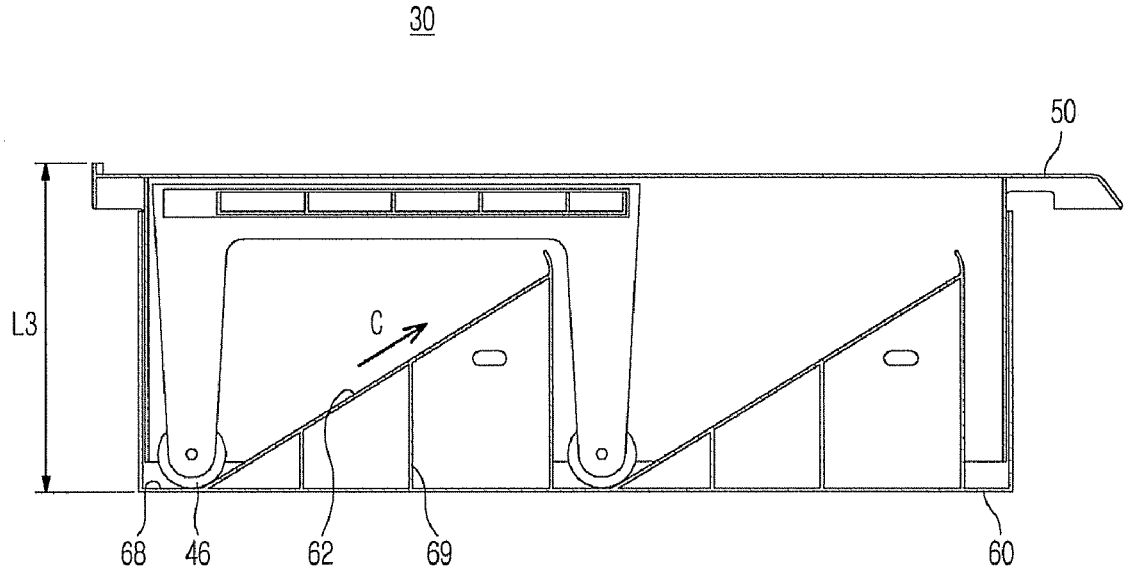
FIGS. 7 and 8 illustrate side views showing an operation of the shelf assembly of FIG. 1.
Figure 8:
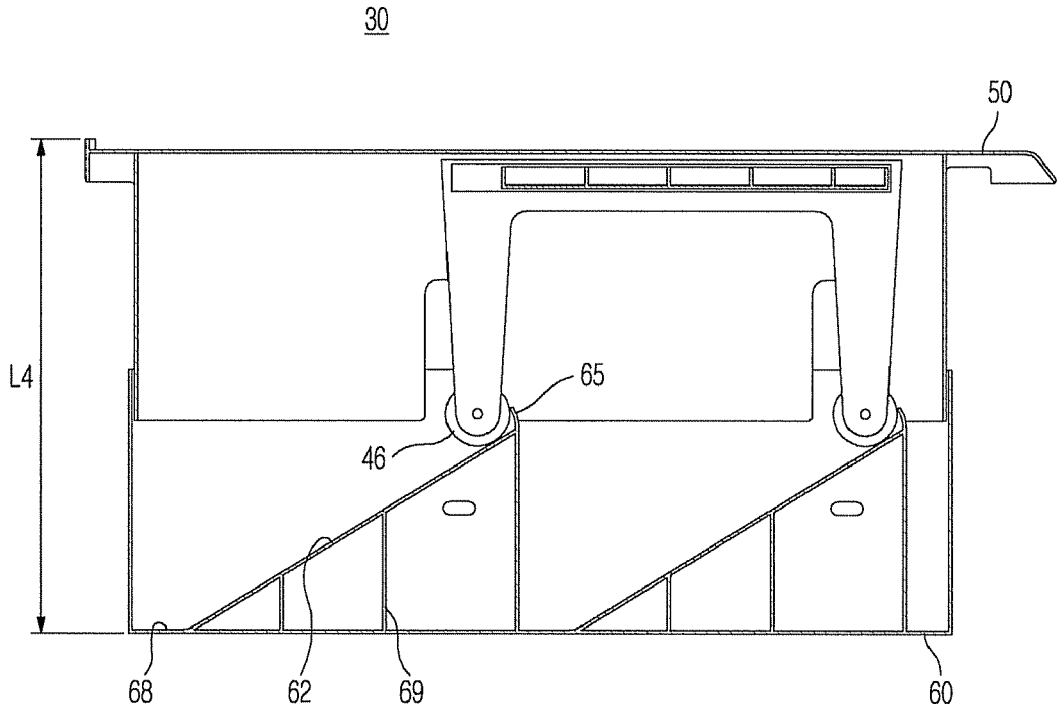

FIGS. 5 and 6 illustrate plan views showing the configuration and the operation of the pressing/fixing unit. FIGS. 7 and 8 illustrate side views showing an operation of the shelf assembly of FIG. 1. For reference, the plan view of FIG. 5 corresponds to the side view of FIG. 7 and the plan view of FIG. 6 corresponds to the side view of FIG. 8.

The following description will be given in conjunction with the case in which the shelf assembly 30 moves from an initial position corresponding to a minimum height L3 of the shelf unit 50 to a position corresponding to a maximum height L4 of the shelf unit 50. Referring to this description, the movement of the shelf assembly 30 in a direction opposite to that of the above case or from a certain position to another certain position can be easily understood.

The shelf assembly 30 may be initially positioned at the minimum height L3. When the shelf assembly 30 is positioned at the minimum height L3, a space above the shelf assembly 30 is ensured, but a space under the shelf assembly 30 is relatively small. When the user intends to store an article having a large volume in the space under the shelf assembly 30, he can move the shelf assembly 30 to the maximum height L4.

In order to move the shelf assembly 30 from the minimum height L3 to the maximum height L4, the user grasps the pressing portion 86 and applies a force thereto in the pressing direction A. As the force is applied to the pressing portion 86, the pressing portion 86 is moved in the pressing direction A, and at the same time, the stopper 84 is moved in the separation direction B. When the stopper 84 moves in the separation direction B, the stopper 84 is uncoupled from the engaging portions 82.

When the stopper 84 is uncoupled from the engaging portions 82, the user pulls the support unit 40 forward while grasping the pressing portion 86. When the support unit 40 is pulled forward, the rollers 46, which are positioned on the flat portions 68 of the lowest end, perform a rolling motion in an oblique direction C along the inclined portions 62. Accordingly, even when a relatively heavy article is placed on the shelf unit 50, the support unit 40 can be moved with only a relatively small force. Several reinforcement ribs 69 are provided under the inclined portions 62 to reinforce strength.

The extended portions 52 (see FIG. 3) of the shelf unit 50 are inserted into the guide portions 64 (see FIG. 4) of the guide units 60. The front and rear surfaces 56 and 57 of the extended portions 52 (see FIG. 3) are in contact with the front and rear wall surfaces 66 and 67 of the guide portions 64 (see FIG. 4) to restrict the forward and backward movement. Accordingly, the shelf unit 50 is influenced only by the vertical movement of the support unit 40 without being influenced by the forward and backward movement of the support unit 40. The user can lift the shelf unit 50 up to the maximum height L4 by simply extracting the support unit 40 forward. Since the stop ribs 65 are formed at the ends of the inclined portions 62, the rollers 46 are prevented from being separated from the inclined portions 62. Further, since the guide bars 70 are provided between the support unit 40 and the shelf unit 50, the support unit 40 can be smoothly moved forward and backward. As the support unit 40 is moved up along the inclined portions 62 by the operation of extracting the support unit 40 forward, the shelf unit 50 placed on the support unit 40 is also moved up.

When the shelf unit 50 is positioned at the desired maximum height L4 by the operation of extracting the support unit 40 forward, a grasping force is removed from the pressing portion 86. When an external force applied to the pressing portion 86 is removed, the pressing portion 86 is moved in the opposite direction to the pressing direction A. When the pressing portion 86 is moved in the opposite direction to the pressing direction A, the stopper 84 is moved in the opposite direction to the separation direction B by the elastic force of the elastic springs 83. When the stopper 84 is moved in the opposite direction to the separation direction B, the ends of the stopper 84 are engagedly coupled with the engaging portions 82. When the stopper 84 and the engaging portions 82 are engagedly coupled with each other, the shelf unit 50 does not slide down along the inclined portions 62 even though the external force is removed from the shelf unit 50.

Figure 9:
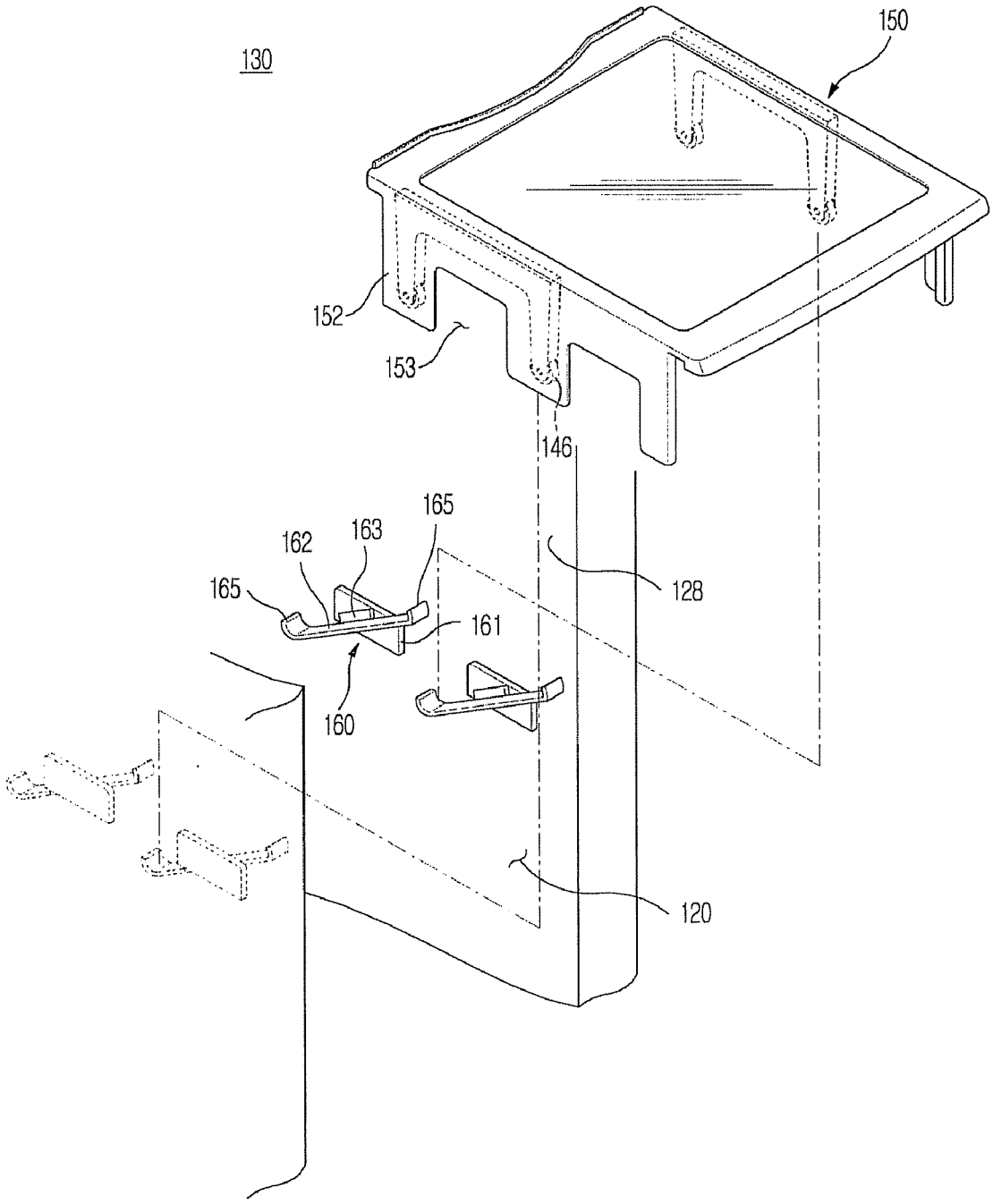
FIG. 9 illustrates a perspective view of a shelf assembly according to a second embodiment of the present invention.

FIG. 9 illustrates a perspective view of a shelf assembly according to a second embodiment of the present invention.

A shelf assembly 130 according to the second embodiment of the present invention includes guide units 160 formed on opposite inner walls 128 of a storage compartment 120. Each guide unit 160 includes an engaging part 161 integrally formed with the corresponding inner wall 128 during the formation of the inner wall 128. An inclined portion 162 is formed on the engaging part 161. Stop ribs 165 are formed on upper and lower ends of the inclined portion 162 to prevent a roller 146 from being separated from the inclined portion 162. Further, a bent portion 163 is formed on the inclined portion 162 in an upward direction to prevent the roller 146 from being laterally separated from the inclined portion 162.

Evading parts 153 are formed on extended portions 152 extended downward from a shelf unit 150 and are fitted around the engaging parts 161. Since the evading parts 153 are fitted around the engaging parts 161, the forward and backward movement of the shelf unit 150 is restricted, and the shelf unit 150 only moves up and down.

Figure 10:
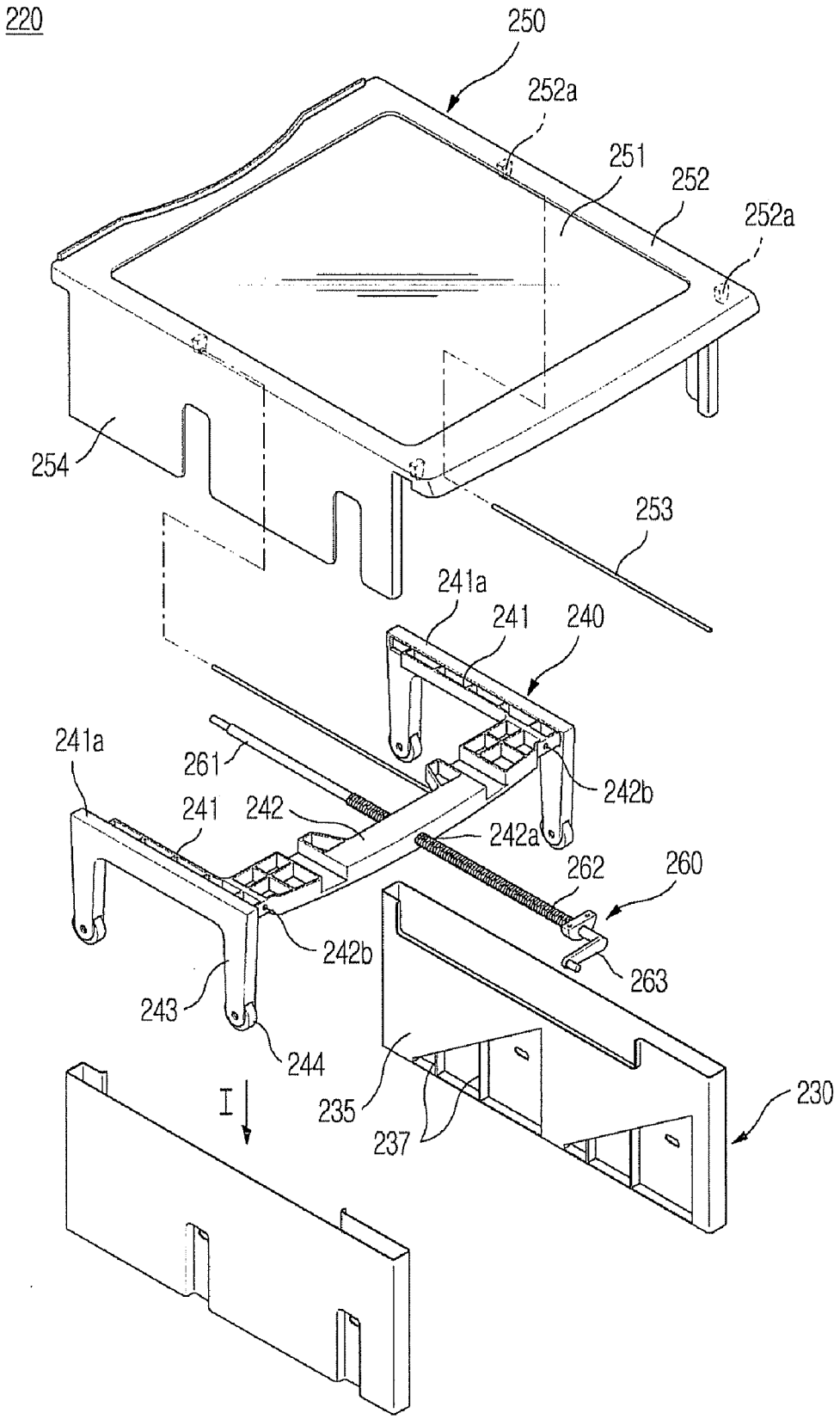
FIG. 10 illustrates an exploded perspective view of a shelf assembly according to a third embodiment of the present invention.
Figure 11:
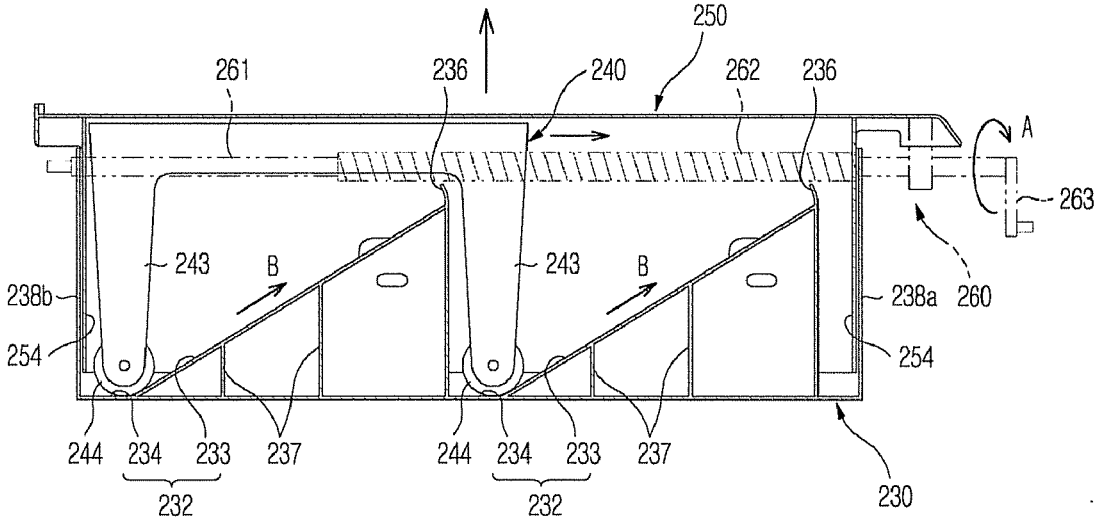
FIGS. 11 and 12 illustrate side views showing an operation of the shelf assembly of FIG. 10.
Figure 12:
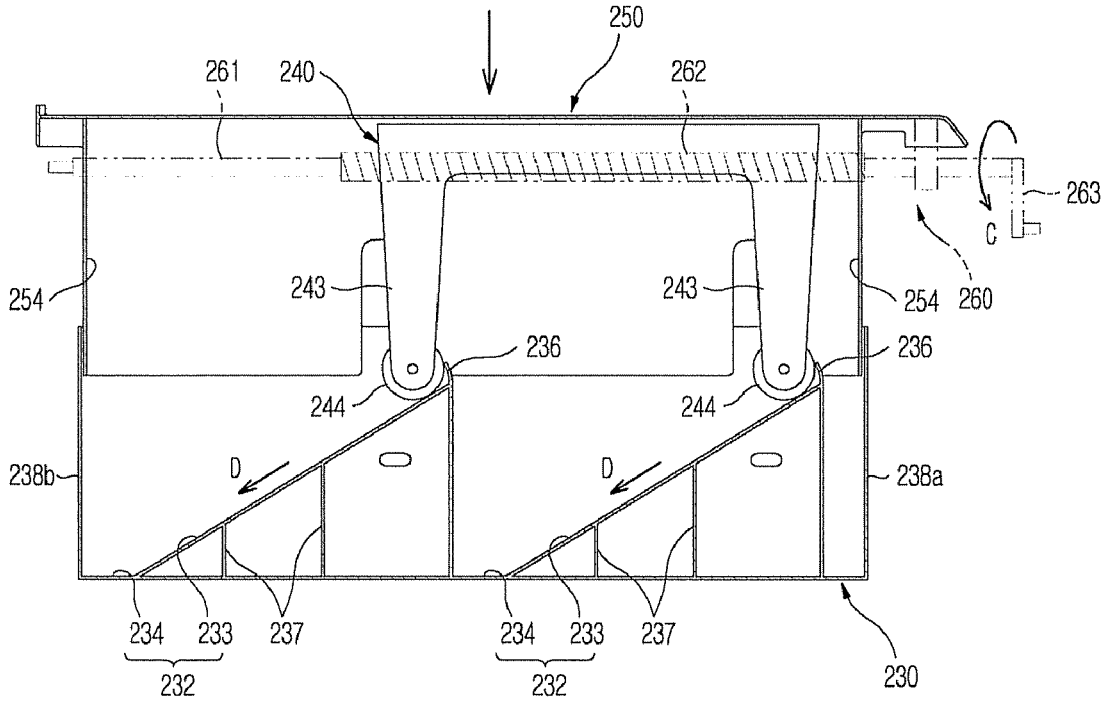

FIG. 10 illustrates an exploded perspective view of a shelf assembly according to a third embodiment of the present invention. FIGS. 11 and 12 illustrate side views showing an operation of the shelf assembly of FIG. 10.

A shelf assembly 220 according to the third embodiment of the present invention includes a rotation driving unit 260 which enables a support unit 240 to move obliquely in order to vertically adjust a shelf unit 250.

As shown in FIG. 10, the support unit 240 which supports the shelf unit 250 includes frames 241 and 242 which horizontally support the shelf unit 250, a plurality of legs 243 extended downward from the frames 241 and 242, and rollers 244 which are rotatably fixed to the ends of the legs 243 and rotate while being supported by rails 232 when the support unit 240 moves along the rails 232.

The frames 241 and 242 connect the upper ends of the legs 243 to each other. The frames 241 and 242 include a pair of lateral frames 241 each connecting a pair of the legs 243 spaced from each other by a specific distance in the forward and backward directions, and a longitudinal frame 242 which connect the pair of lateral frames 241.

In this case, upper surfaces 241*a* of the lateral frames 241 are maintained in contact with the lower surfaces of the shelf unit 250 to support the shelf unit 250.

At the center of the longitudinal frame 242, there is provided a female threaded portion 242*a* which is threadedly coupled to a threaded portion 262 of the rotation driving unit 260. At the opposite sides of the longitudinal frame 242, there are provided guide holes 242*b* into which a pair of guide bars 253 are inserted in order to prevent shaking and allow a smooth sliding motion when the support unit 240 moves forward and backward with respect to the shelf unit 250.

The rotation driving unit 260 is provided to allow the support unit 240 to move obliquely.

The rotation driving unit 260 includes a rod 261 rotatably mounted to a central portion of the rear surface of the shelf unit 250 and the threaded portion 262 formed at a specific region of the rod 261. The rotation driving unit 260 also includes a knob 263 provided at a leading end of the rod 261 to rotate the rod 261.

The threaded portion 262 is inserted into the female threaded portion 242*a* formed in the longitudinal frame 242 of the support unit 240. Accordingly, the support unit 240 is moved forward and backward in a longitudinal direction of the threaded portion 262 by the rotation of the threaded portion 262.

Thus, when the user rotates the knob 263 clockwise and counterclockwise, the threaded portion 262 is rotated clockwise and counterclockwise, and the support unit 240 is moved forward and backward in the longitudinal direction of the threaded portion 262.

Next, an operation of a shelf assembly according to the embodiment of the present invention will be described.

FIG. 11 illustrates the operation of the shelf assembly according to the present invention, in which the shelf unit is lifted down. FIG. 12 illustrates the operation of the shelf assembly according to the present invention, in which the shelf unit is lifted up.

FIG. 11 shows an unlifted state wherein the legs 243 are positioned at horizontal portions 234 and the shelf unit 250 is maintained at a minimum height. When the user rotates the knob 263 in an A direction in the unlifted state to rotate the threaded portion 262 in the A direction, the support unit 240 moves forward in the longitudinal direction of the threaded portion 262 by the rotation of the threaded portion 262. Accordingly, the support unit 240 moves obliquely in a B direction.

The shelf unit 250 loaded on the support unit 240 also moves in the same way according to the oblique movement of the support unit 240. The shelf unit 250 moves only vertically while the forward movement of the shelf unit 250 is prevented by front portions 238*a* of guide units 230. In this case, the support unit 240 smoothly moves forward with respect to the shelf unit 250 along the guide bars 253 provided in the shelf unit 250. Accordingly, the shaking can be prevented when the shelf unit 250 is lifted up and down.

Then, when the user removes a force applied to the knob 263, the rotation of the threaded portion 262 is completed and the legs 243 of the support unit 240 are fixed at specific positions on inclined portions 233. Accordingly, the support unit 240 does not move downward along the inclined portions 233 and is maintained at a specific position in spite of the weight of the support unit 240, the shelf unit 250 and food placed on a shelf member 251.

As shown in FIG. 12, when the user rotates the knob 263 in a C direction to rotate the threaded portion 262 in the C direction, the support unit 240 moves backward in the longitudinal direction of the threaded portion 262 by the rotation of the threaded portion 262. Accordingly, the support unit 240 moves obliquely in a D direction.

The shelf unit 250 mounted on the support unit 240 also moves in the same way according to the oblique movement of the support unit 240. The shelf unit 250 can move only vertically and downward while the backward movement of the shelf unit 250 is prevented by rear portions 238*b* of guide portions 238. In this case, the support unit 240 smoothly moves backward with respect to the shelf unit 250 along the guide bars 253 provided in the shelf unit 250. Accordingly, the shaking can be prevented when the shelf unit 250 is lifted up and down.

As described above, the shelf assembly according to the embodiments of the present invention has a simple configuration by omitting a complicated gear device provided in the conventional elevation unit. Thus, it is possible to simplify a manufacturing process and reducing manufacturing costs.

Further, since the shelf unit is supported by a pair of the guide units which are threadedly coupled and fixed to the opposite sidewalls of the storage compartment, the shelf assembly adapted to lift the shelf up and down can be mounted in the storage compartment even when a track is not installed in the storage compartment. Even when the shelf assembly is manufactured using an injection molded product made of a resin material instead of a stiff material such as metal, it is possible to ensure support performance corresponding to the conventional metal shelf.

Although a side by side (SBS) refrigerator is explained as an example in the above embodiments, the present invention may be applied to various refrigerators without being limited thereto.

Further, although the user directly applies an external force to the driving unit to operate the driving unit in the above embodiments, the driving unit may be automatically operated by an electric device or the like.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

a storage compartment; and a shelf assembly provided in the storage compartment to be vertically adjustable, wherein the shelf assembly includes a support unit provided to be movable obliquely, guide units having inclined portions which guide the oblique movement of the support unit, and a shelf unit which is mounted on the support unit to move up and down according to an oblique movement of the support unit, and the shelf unit maintains a constant distance from the rear of the storage compartment.

2. The refrigerator according to claim 1, wherein the shelf assembly further includes a driving unit to drive the support unit.

3. The refrigerator according to claim 2, wherein the driving unit is a pressing/fixing unit including a plurality of engaging portions provided in the shelf unit, and a stopper provided in the support unit such that the stopper is selectively coupled to and separated from any one of the engaging portions.

4. The refrigerator according to claim 3, wherein the pressing/fixing unit further includes a pressing portion which moves the stopper forward and backward, and the stopper interlocking with the pressing portion is separated from the engaging portions when a certain external force is applied to the pressing portion.

5. The refrigerator according to claim 2, wherein the driving unit is a rotation driving unit including a threaded portion, and the rotation driving unit allows the support unit to move forward and backward along inclined portions of guide units by a rotation of the threaded portion.

6. The refrigerator according to claim 5, wherein the rotation driving unit further includes a knob which is grasped by a user to rotate the threaded portion.

7. The refrigerator according to claim 1, wherein the guide units include a pair of guide units fixed to opposite side surfaces of the storage compartment.

8. The refrigerator according to claim 1, wherein the shelf unit further includes extended portions, and the guide units further include guide portions which receive the extended portions to guide an elevation of the shelf unit.

9. The refrigerator according to claim 8, wherein the guide portions prevent the movement of the shelf unit in the forward or backward direction.

10. The refrigerator according to claim 9, wherein the extended portions are provided at opposite sides of the shelf unit and the extended portions at each of the opposite sides include a plurality of cut-outs to be coupled to the guide portions.

11. The refrigerator according to claim 1, wherein the guide units having the inclined portions which guide the oblique movement of the support unit are formed integrally with opposite sidewalls of the storage compartment.

12. The refrigerator according to claim 1, wherein the inclined portions are arranged parallel to each other.

13. The refrigerator according to claim 1, wherein the support unit includes a frame which supports the shelf unit and legs which are extended from the frame and supported by the inclined portions.

14. The refrigerator according to claim 13, wherein the legs move obliquely along the inclined portions.

15. The refrigerator according to claim 13, wherein the legs further include rollers to be smoothly movable along the inclined portions.

16. The refrigerator according to claim 1, wherein the shelf unit is vertically lifted up according to an upward oblique movement of the support unit, and is vertically moved downward according to a downward oblique movement of the support unit.

17. The refrigerator according to claim 1, wherein the support unit moves forward and backward with respect to the shelf unit.

18. A refrigerator comprising:

a storage compartment; and a shelf assembly provided in the storage compartment, wherein the shelf assembly includes guide units fixedly coupled to opposite sidewalls of the storage compartment and having inclined portions, a support unit moving along the inclined portions, and a shelf unit which is coupled to the support unit to move up and down according to a movement of the support unit, and the shelf unit maintains a constant distance from the rear of the storage compartment.

19. The refrigerator according to claim 18, wherein the shelf assembly further includes a pressing/fixing unit having a plurality of engaging portions provided in the shelf unit, a stopper provided in the support unit and selectively coupled to and separated from any one of the engaging portions, and a pressing portion which moves the stopper forward and backward.

20. The refrigerator according to claim 18, wherein the shelf assembly further includes a rotation driving unit which allows the support unit to move forward and backward along the inclined portions of the guide units by a rotation of a threaded portion.

21. A refrigerator comprising:

a storage compartment; and a shelf assembly provided in the storage compartment to be vertically adjustable, wherein the shelf assembly includes a shelf unit, a support unit provided to move forward and backward with respect to the shelf unit and move up and down, a driving unit which drives the support unit, and fixed guide units having inclined portions which guide an oblique movement of the support unit, and the shelf unit maintains a constant distance from the rear of the storage compartment.

22. The refrigerator according to claim 1, wherein the inclination of the inclined portions is a straight line.

23. The refrigerator according to claim 1, wherein at least one of the guide units is further provided with a stopper rib disposed at one end of the inclined portions to limit the movement of the support unit.

24. The refrigerator according to claim 1, wherein a plurality of inclined portions are provided at each side of the storage compartment.

* * * * *

UNITED STATES PATENT AND TRADEMARK OFFICE

CERTIFICATE OF CORRECTION

PATENT NO. : 8,376,482 B2
APPLICATION NO. : 12/401666
DATED : February 19, 2013
INVENTOR(S) : Jae Koog An et al.

It is certified that error appears in the above-identified patent and that said Letters Patent is hereby corrected as shown below:

On the Title Page Col. 1, insert

-- (30) Foreign Application Priority Data

Jun. 12, 2008 (KR) ..... 10-2008-0055157 --.

Signed and Sealed this
Fifth Day of November, 2013

Teresa Stanek Rea

Teresa Stanek Rea
*Deputy Director of the United States Patent and Trademark Office*